United States Patent [19]

Crawford

[11] 4,056,326

[45] Nov. 1, 1977

[54] LOOSE LEAF BINDER

[75] Inventor: Kenneth Z. Crawford, Crawfordsville, Ind.

[73] Assignee: Crawford Industries, Inc., Crawfordsville, Ind.

[21] Appl. No.: 602,229

[22] Filed: Aug. 6, 1975

[51] Int. Cl.[2] ..... B42F 13/30

[52] U.S. Cl. ..... 402/30; 402/46; 402/47; 402/74

[58] Field of Search ..... 402/47, 46, 30, 74, 402/75; 281/29, 36, 37; 16/DIG. 13

[56] References Cited

U.S. PATENT DOCUMENTS

| | | | |
|---|---|---|---|
| 1,101,780 | 6/1914 | Blaylock | 402/46 |
| 1,954,265 | 5/1932 | Schade | 402/47 |
| 2,253,039 | 12/1939 | Lewis | 402/47 |
| 2,255,121 | 9/1941 | Lakso | 402/30 |
| 2,255,136 | 9/1941 | Vogt et al. | 402/30 |
| 2,318,941 | 10/1942 | Henderson | 402/47 |
| 2,320,101 | 9/1942 | Schade | 402/75 X |
| 2,646,800 | 6/1950 | Ratcliffe et al. | 402/46 |
| 3,097,652 | 7/1963 | Villhard | 402/47 |
| 3,454,694 | 7/1969 | Delaire et al. | 281/29 |
| 3,612,709 | 10/1971 | Miyamoto | 402/22 |
| 3,793,612 | 2/1974 | Driscoll | 16/DIG. 13 |

FOREIGN PATENT DOCUMENTS

| | | | |
|---|---|---|---|
| 621,343 | 2/1927 | France | 402/74 |
| 1,051,693 | 9/1953 | France | 402/74 |
| Ad.68,441 | 11/1957 | France | 402/46 |
| 879,113 | 10/1961 | United Kingdom | 402/47 |
| 1,056,999 | 2/1967 | United Kingdom | 16/DIG. 13 |
| 1,243,752 | 8/1971 | United Kingdom | 281/29 |
| 1,009,441 | 11/1965 | United Kingdom | 281/29 |
| 1,104,022 | 10/1964 | United Kingdom | 281/29 |

*Primary Examiner*—Jerome Schnall

*Attorney, Agent, or Firm*—Jenkins, Coffey & Hyland

[57] ABSTRACT

A stiff plastic sheet is heat-scored on spaced parallel lines to form front and rear binder covers hinged at the score lines to a wide backbone. Two post-mounting units formed of similar plastic sheet material have a base strip along one edge and a post-supporting strip along the other edge, connected by a web which is heat-scored so as to flex at two-spaced flex lines and which is cut away at spaced areas to leave a series of straps between the strips so that together they are more flexible than the cover hinges. The base strips are ultrasonically welded to the covers along the inner edges of the covers so as to hold the post-supporting strips for swinging movement about the flex lines which are spaced outward from the hinge lines between the covers and the backbone. Three extensible posts are connected by mounting bars to the two post-supporting strips and hold such strips in parallel but separable relation, in an arrangement such that in closed position of the covers the post-supporting strips lie substantially flat against the inner faces of the covers, and the posts are in shortened state. As the covers are swung about the cover hinge lines to open position, the web straps flex, the post-supporting strips are held parallel by the posts, the thus-held parallel post-supporting strips are carried outward to a more widely-spaced position in which they stand substantially perpendicular to the open covers at positions spaced outward from the edges of the backbone, and the posts are thereby substantially lengthened. The binder provides a compact container for a full stack of filler leaves and automatically lengthens the binder posts when opened so as to provide convenient access to its contents. The binder is especially adapted to be made of thermoplastic sheet stock, and requires no externally exposed rivets or other mechanical fasteners.

8 Claims, 4 Drawing Figures

LOOSE LEAF BINDER

BACKGROUND OF THE INVENTION

This invention relates to a post binder of the type used for catalogs and reference works and the like in which a relatively thick stack of replaceable leaves is held by a post mechanism having a plurality of straight posts extending through the stack. There is a basic need for a binder of this type which will close to a condition in which it is little thicker than the thickness of the stack of leaves and will open to a condition in which the leaves are loose and separated from each other so as to lie open for convenient examination.

There are available on the market a number of extensible-post binders in which the backbone of the cover structure consists of two or more sliding parts which can be pushed to a collapsed condition when closed and pulled to an expanded position when opened. These require a relatively complex structure, are not held collapsed when closed, and in general are awkward and unattractive. See, for example, U.S. Pat. No. 2,784,719 issued Mar. 12, 1957 to C. J. Panfil. Other extensible-post binders on the market rely primarily on the post structure to support the covers and either have no backbone between the covers or have merely flexible facing between the covers which flexes to allow the post structure to be manually expanded and collapsed. See, for example, U.S. Pat. No. 2,253,039 issued Aug. 19, 1941 to G. Lewis.

The present invention provides an improved binder in which the post mechanism is automatically expanded as the binder is opened and automatically collapsed as the binder is closed. The binder is especially adapted to be made with a one-piece cover structure formed of stiff plastic sheet material, and which when closed has an especially neat and attractive appearance with no exposed rivets or the like.

SUMMARY OF THE INVENTION

In accordance with the invention, the binder consists of a cover structure, two post-mounting units, and a post mechanism having a plurality of extensible posts. The cover structure is preferably made from a single sheet of stiff plastic sheet stock in which hinges are formed between the backbone and the covers by heat-scoring or the like so that the covers swing on definite hinge lines at the edges of the backbone, and the backbone is of stiff material and of fixed width. Each cover carries a post-mounting unit fixed to its inner face adjacent its hinged edge. Each such unit is formed from an elongated piece of stiff plastic material having a central flexible web portion between two edge strips. One strip, referred to as a base strip, is fixed to the inner face of the cover adjacent its hinged edge, as by ultrasonic welding. The other strip, referred to as a post-mounting strip, is fixed to the mounting bar of an extensible post mechanism. The web portion of each post-mounting unit is made flexible as by heat-scoring or the like on at least two spaced flex lines about which the edge strips may swing relative to each other and which permit a certain degree of offset and other limited movement between the two edge strips. The web portion of the post-mounting unit is desirably also cut away over portions of its length, to leave a plurality of spaced web straps extending between the edge portions. Such straps together have greater flexiblity than the hinges between the covers and the backbone of the binder, to facilitate the operation of the binder and insure that the covers will swing about the hinges of the backbone.

The post mechanism may be of a conventional type which has a plurality of extensible posts extending between and perpendicular to elongated flat mounting bars at their ends. The two bars are fixed to the post-supporting strips of the post-mounting units on the two covers, with at least one releasable to permit the usual disassembly of the post mechanism of insertion and removal of leaves in the binder. The arrangement is such that the covers have a closed position in which they are in face-to-face and generally parallel relation, with the post-supporting strips lying substantially flat against their inner faces. The posts are then in shortened state and extend generally perpendicular between the covers. As the covers are swung outward from this closed position about their hinges at the edges of the backbone, they move toward an open position in which they lie substantially coplanar with the backbone. Such movement of the covers carries with them the base strips of the post-mounting units, while the posts, being rigid and perpendicular to their mounting bars and the post-supporting strips, hold such strips in substantially parallel relation, and this causes the webs of the post-mounting strips to be flexed as the covers swing. The covers and the base strips are thus caused to swing angularly both about the cover hinges and with respect to the post-supporting strips, and the latter strips are carried in parallel relation outward to a position of greater spacing than when the covers are closed. This automatically extends and lengthens the posts so that the leaves mounted in the binder may spread and lie well open in the binder for ready examination.

The one-piece cover and backbone structure of the binder is desirably made of a stiff plastic sheet of thermoplastic polymer, such as any of a number of polyolefin polymers available on the market. The preferred material is a mixture of polyethylene and polypropylene polymers available on the market under the trademark "Polyallomer", from Eastman Chemical Products, Inc., Rochester, N.Y. A second preferred material is a medium density polyethylene polymer, which may be formed from a mixture of high density and low density polyethylene stock. Polypropylene and other polyolefin polymers may also be used. The material used is desirably thermoplastic and is adapted to be heat-scored to form integral hinges of good flexibility and long life, and is weldable as by ultrasonic welding. The post-mounting units are desirably formed of the same or similar plastic material but may be of thinner gauge than the cover stock. By way of example, the cover stock may range in thickness from 0.075 inch to 0.125 inch depending on the thickness of the binder, and the post-mounting strips may be 0.075 inch thick. The use of plastic post-mounting units welded ultrasonically to the covers provides an especially effective mounting for the post mechanism, provides automatic expansion as the binder is opened, and gives a binder of attractive appearance which does not require the presence of exposed rivets or other mechanical fasteners.

BRIEF DESCRIPTION OF THE DRAWINGS

The accompanying drawings illustrate the invention, and show the best mode presently contemplated of carrying out the invention. In such drawings.

DESCRIPTION OF THE PREFERRED EMBODIMENT

Figure 1:
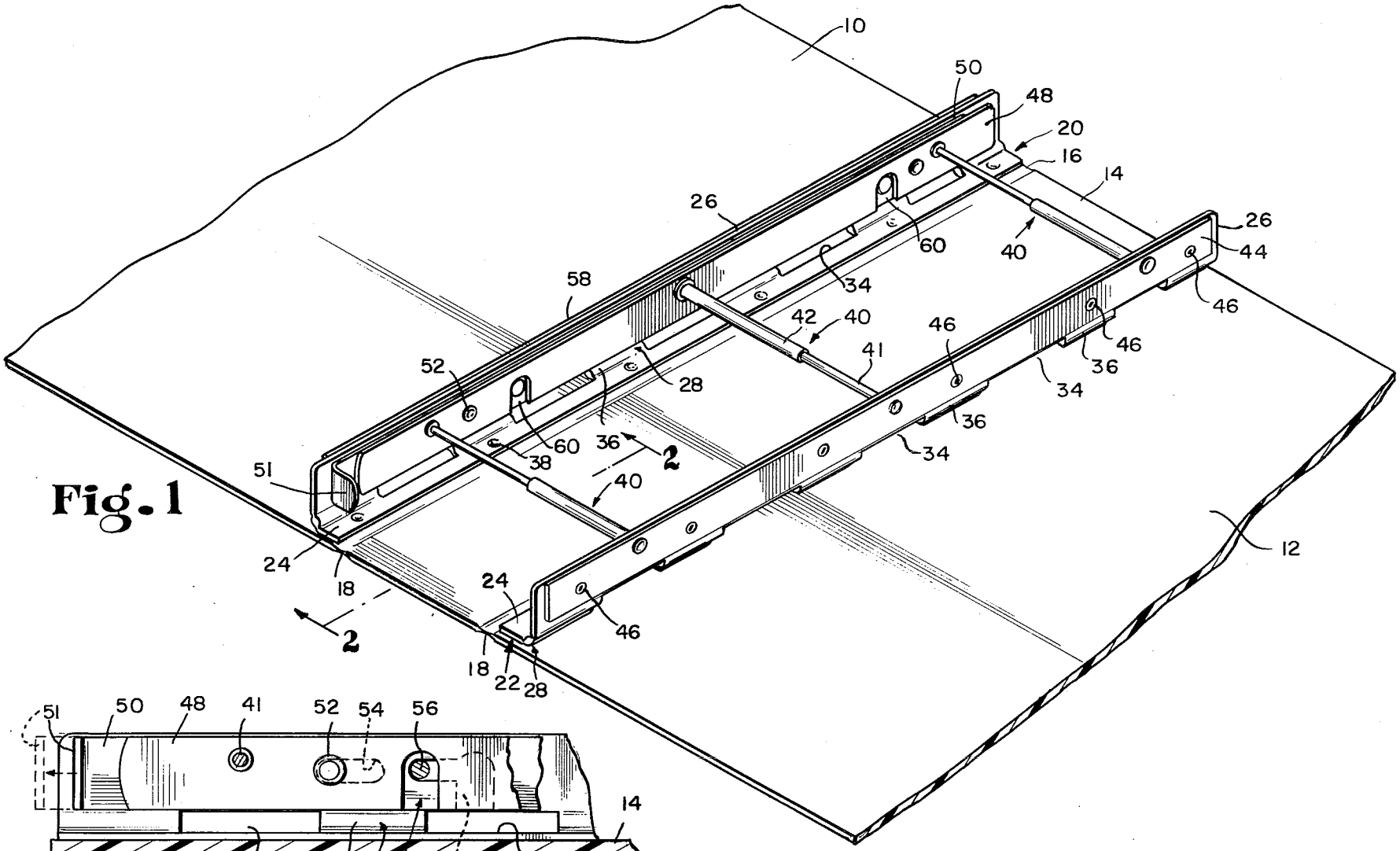
FIG. 1 is an isometric view of a binder embodying the invention, shown in open position.

The binder shown in the drawings comprises a front cover 10, a rear cover 12, and a backbone 14 to which the covers are hinged at their inner edges for movement between a closed position in which the covers are in face-to-face and generally parallel relation, and an open position in which the covers are substantially coplanar with the backbone 14. Preferably, the covers and backbone are formed from a one-piece sheet of stiff plastic material, by heat-scoring the material on spaced parallel lines to form hinges 16 and 18 between the inner edges of the covers and the backbone 14. For a thick binder such as a 4-inch binder the cover stock may be 0.125 inch thick and for a thinner binder such as a 1½ to 2-inch binder the cover stock may be 0.075 inch thick.

Post-mounting units 20 and 22 are fixed to the inner faces of the covers 10 and 12, adjacent and parallel to the inner hinged edges of those covers. Each post-mounting unit is in the form of an elongated piece of stiff plastic material, of say 0.075 inch thickness, formed to provide an inner base strip 24 along one edge and a post-mounting strip 26 along the opposite edge, with the two strips joined by an intermediate web portion 28. The web portion is heat-scored along two parallel spaced lines to form a pair of spaced hinge lines 30 and 32 at the inner edges of the two strips 24 and 26. Also, the web is desirably cut away over spaced portions 34 to leave the web as a series of spaced flexible straps 36 extending between the two strips 24 and 26. Such straps together are desirably more flexible than the cover hinges. The post-mounting units 20 and 24 are attached to the inner faces of the two covers, by fixing the base strips 24 to such covers along their inner edges adjacent but outward from the hinges 18. Desirably, the base strips are attached to the covers by ultrasonic welding, as at a series of spaced points 38 along the length of the strip 24.

The post mechanism is of a conventional type and comprises three extensible posts 40 each having a bar section 41 telescopically received in a tubular section 42. One end of each post is fixed to an elongated flat post bar 44 and stands perpendicular to the plane of that bar. The bar 44 is fixed against the outer face of the post-mounting strip 26 of the post-mounting unit 22 shown at the right side of the backbone 14, and the posts pass through suitable openings in that strip 26. The bar 44 is conveniently fixed to the strip 26 by rivets 46.

Figure 2:
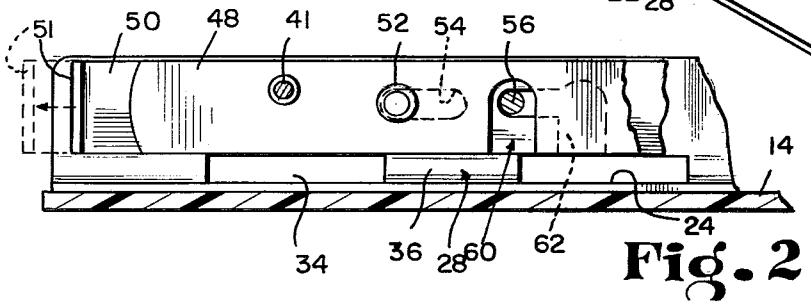
FIG. 2 is a fragmental sectional view taken on the line 2—2 of FIG. 3, showing the operation of the releasable latch of the post mechanism.

The opposite end of each extensible post 40 is fixed to a movable post bar 48 which carries a slidable latch bar 50. As shown in FIG. 2, the latch bar 50 is secured to the post bar 48 by a pair of rivets 52 which pass through elongated slots 54 in the latch bar so that the latch bar is slidable lengthwise of the post bar 48. In latched position, the latch bar 50 lies against the front face of the post-mounting strip 26 of the post-mounting unit 20 and is engaged with a pair of studs 56 projecting through the strip 26 from a keeper bar 58 mounted against its back face and secured thereto by rivets (not shown). For engagement over each stud 56, the post bar 46 is formed with a downward-open notch 60 and the latch bar 50 is formed with an L-shaped notch 62 which lies behind the head of the stud 56 when the latch bar 50 is in latching position, as shown in full lines in FIGS. 1 and 2. The latch bar is released from the stud 56 when it is moved lengthwise to bring the vertical leg of the L-shaped notch 62 into alignment with the notch 60. For actuating the latch bar 50, it has an inturned finger or handle 51 at its left end. In FIG. 2, such handle is shown in latched position in full lines, and in released position in dotted lines.

Figure 3:
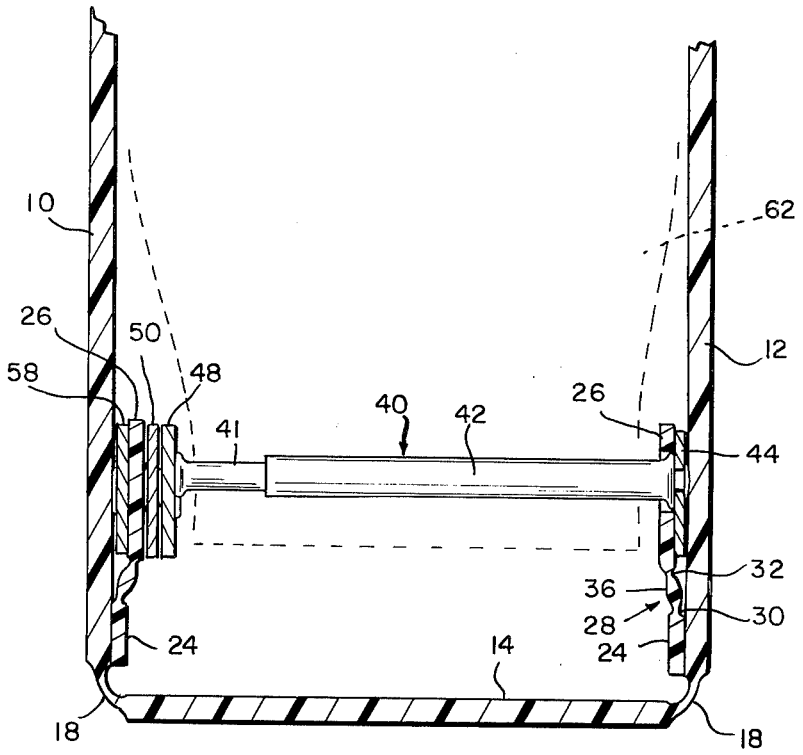
FIG. 3 is a transverse sectional view of the binder of FIG. 1, with the parts shown in binder-closed position.
Figure 4:
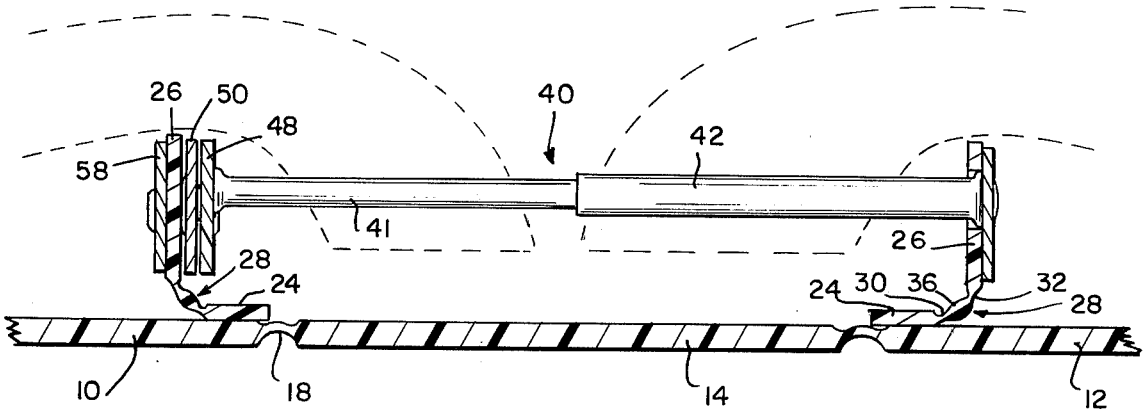
FIG. 4 is a sectional view analogous to FIG. 3, showing the binder in open position.

In operation, the binder has a closed position as shown in FIG. 3, in which the front and back covers 10 and 12 stand in face-to-face and generally parallel relation with each other and in which the post-supporting strips, with the bars 44 and 58 on their outer faces, lie substantially flat against the inner faces of such covers, held in spaced parallel position by the interconnecting action of the extensible post 40. Because of the presence of the bars 44 and 58, the strips 26 are not coplanar with the base strips 24, but are offset inward therefrom, which offsetting is permitted by the two spaced hinge lines 30 and 32. In the binder-closed position, the posts 40 are in shortened state, with their bar elements 41 telescoped into the tubular elements 42. The binder is adapted to contain a full stack of loose leaves 62 which substantially fills the closed binder so that the covers lie flat against the stack and the overall thickness of the binder is very little greater than the thickness of the stack. When the covers are swung outward from their closed position in FIG. 3 to their open position shown in FIG. 4, they move to a substantially coplanar relationship with the backbone 14. As they swing outward and downward, they carry with them the base strips 24 of the post-mounting units so that those base strips move angularly from a parallel relation to a substantially coplanar relation. The post-supporting strips 26 of the post-mounting units, however, are held parallel by the extensible posts and the plates fixed to the post ends and to the strips. Accordingly, as the base strips 24 swing angularly outward, they rotate through 90° with respect to the parallel post-supporting strips, and this flexes the web straps 36. As shown in FIG. 4, the web flexing is distributed between the two spaced hinge lines 30 and 32. The binder-opening movement carries the post-supporting strips 26 bodily outward and downward from their closed position shown in FIG. 3, and extends the posts 40. The extension may be of the order of 60% or more of the length of the collapsed posts. Such extension loosens the stack of loose leaves and allows them to fall open in a loose and conveniently readable arrangement, as generally indicated in FIG. 4.

When the binder is in open position as shown in FIG. 4, the post-supporting strips 26 are flexibly and somewhat resiliently supported by the flexible straps 36 which are flexible about both of the two hinge lines of the hinges 30 and 32. This gives the post-supporting strips 26 some freedom of bodily movement vertically and horizontally, and facilitates the use and operation of the binder. Desirably, the strips 36 and their hinges 30 and 32 are more flexible than the hinges 18 between the covers and the backbone, which facilitates the operation and insures that when the covers are moved between open and closed positions they swing accurately about the hinge lines of the hinges 18.

When it is desired to remove and replace one or more leaves in the binder, the latch bar 50 is moved lengthwise to bring the side openings of its notches 62 into alignment with the notches 60, which allows the latch bar 50 and post bar 48 to be released from the studs 56. The stack of leaves is then laid over against the back cover 12 and the upper halves of the extensible posts 40 are removed, and this frees the stack of leaves for removal and replacement in whole or in part.

I claim:

1. A loose leaf binder, comprising a one-piece sheet of stiff plastic having a pair of spaced hinge lines formed therein so as to provide stiff front and rear covers and a stiff backbone of fixed width to which the covers are hinged at their inner edges for movement between a closed parallel position and an open position substantially coplanar with the backbone, a post-mounting unit fixed to the inner face of each cover adjacent its hinged edge, each such unit being an elongated member of stiff plastic material having a central web portion between two edge strips, one edge strip being a base strip which has a free edge opposite said central web portion and which is fixed flat against the inner face of the cover with its free edge adjacent the cover hinged edge and extending width-wise from such hinged edge outward along the cover so as to position said web portion in spaced parallel relation with the cover hinge, and the other edge strip being a post-supporting strip, said web portion being modified as by heat-scoring or the like so as to form at least two spaced flex lines about which the edge strips may swing relative to each other, post mechanism including a pluality of extensible posts interconnected by mounting bars at their ends, means to secure the mounting bars to the post-supporting strips of said post-mounting units with the posts held substantially perpendicular to the planes of such strips, the arrangement being such that in the closed parallel position of the covers, the post-supporting strips lie parallel with and said web portions swing close to the inner faces of the covers, to inclined positions between the base and post-mounting strips outward from the base strips, and the posts are in shortened state and extend between the covers and generally perpendicular thereto, and as the covers are swung about their hinges toward their coplanar open position, the posts hold the post-mounting strips in substantially parallel relation, the webs of the post-mounting units are flexed at each of their spaced flex lines, and the covers and base strips swing angularly about the cover hinges with respect to the parallel post-mounting strips and the latter move outward to lengthen the posts and upward relative to the covers so as to support the post-mounting bars in parallel relation and spaced from the open covers.

2. A loose leaf binder as in claim 1, in which said covers and backbone and said post-mounting unit are composed of thermoplastic polyolefin polymer.

3. A loose leaf binder as in claim 1 in which the web of said post mounting unit consists of longitudinally-spaced straps extending between said base strip and post-supporting strip.

4. A loose leaf binder, comprising stiff front and rear covers and a stiff backbone of fixed width to which the covers are hinged on hinge lines at their inner edges for movement between a closed position in which the covers lie in spaced face-to-face relation and an open position in which the covers are substantially coplanar with the backbone, a post-mounting unit fixed to the inner face of each cover adjacent its hinged edge, each such unit being an elongated member of stiff plastic material having an elongated base strip along one edge thereof and fixed to the cover with a free edge adjacent the cover hinge line and extending outwardly of said hinge line to an outer edge spaced from the cover hinge line, a post-supporting strip along the opposite edge thereof, and a web extending from the outer edge of the base strip to the post-supporting strip and containing at least two spaced flex lines about which the edge strips may swing relative to each other, post mechanism including a plurality of extensible posts having mounting means at their ends secured to said post-supporting strips in a manner so as to hold such strips in substantially parallel spaced planes perpendicular to said posts, said mounting means including post-supporting bars lying flat against the outer faces of said post-supporting strips, the arrangement being such that in the closed position of the covers, the post-supporting bars lie substantially flat against the inner faces of the covers, the post-supporting strips lie substantially flat against such bars, outwardly from and in offset parallel relation with the edge strips to which they are connected by the webs, so that there is a leaf-receiving space between the post-supporting strips, and the posts are in shortened state and generally perpendicular to the covers, and as the covers are swung outward toward their open position, the webs of the post-mounting units are flexed on each of their spaced flex lines, and the post-supporting strips are held in substantially parallel spaced relation but are carried outward with the outward-swinging outer edges of the base strips so as to extend and lift the posts and widen the leaf-receiving space between the post-supporting strips and said web portions swing upward from the covers to inclined positions between the base and post-mounting strips.

5. A loose leaf binder as in claim 4 in which the covers and backbone are formed from a one-piece sheet of thermoplastic plastic material and the cover hinges are formed therein by heat-scoring the material along the hinge lines, the post-mounting units are formed of similar thermoplastic material which is heat-scored on at least two spaced lines to provide web flex lines, and said base strips are welded to the inner faces of the covers.

6. A loose leaf binder as in claim 5 in which the said webs are more flexible than the cover hinges.

7. A loose leaf binder as in claim 5 in which the webs are cut away at spaced areas along the length of the post-mounting unit to leave flexible straps interconnecting the edge strips thereof, thereby reducing the operative length of the web and increasing its flexibility.

8. A loose leaf binder as in claim 5 in which the posts are releasably latched to one of the post-supporting strips.

* * * * *

UNITED STATES PATENT OFFICE

CERTIFICATE OF CORRECTION

Patent No. 4,056,326 Dated November 1, 1977

Inventor(s) Kenneth Z. Crawford

It is certified that error appears in the above-identified patent and that said Letters Patent are hereby corrected as shown below:

Column 5, line 24*, change "extending" at the end of the line to --extends--;

line 43*, delete "said web portions swing";

lines 44-45*, delete "to inclined positions between the base and post-mounting strips";

line 56*, change "and upward relative the covers" to read --and said web portions swing upward relative to the covers to inclined positions between the base and post-mounting strips--.

*The line numbers referred to are by actual count of the lines in Column 5, not by the numbers printed between Columns 5 and 6.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*